US006705833B2

(12) United States Patent
Tam et al.

(10) Patent No.: US 6,705,833 B2
(45) Date of Patent: Mar. 16, 2004

(54) AIRFLOW FLAPPER VALVE

(75) Inventors: Victoria Tsang Tam, Davis, CA (US); Chadi Theodossy, Rocklin, CA (US); Kenneth K. Tang, Sacramento, CA (US); Richard B. Nelson, Granite Bay, CA (US); Paul W. Barrows, Rocklin, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 47 days.

(21) Appl. No.: 10/001,003

(22) Filed: Nov. 15, 2001

(65) Prior Publication Data

US 2003/0091433 A1 May 15, 2003

(51) Int. Cl.[7] ..... F04D 25/10

(52) U.S. Cl. ..... 415/146; 415/182.1; 415/203; 415/206; 29/888.024; 29/888.025

(58) Field of Search ..... 415/26, 35, 36, 415/46, 146, 182.1, 203, 206; 137/512.15; 29/888.024, 888.025

(56) References Cited

U.S. PATENT DOCUMENTS 3,807,444 A * 4/1974 Fortune ..... 137/512.15
4,691,623 A * 9/1987 Mizusawa ..... 137/512.15 X
5,167,574 A * 12/1992 Ikeda et al. ..... 137/512.1 X
5,890,959 A * 4/1999 Pettit et al. ..... 454/353 X
6,011,689 A * 1/2000 Wrycraft ..... 454/353 X
6,031,717 A * 2/2000 Baddour et al. ..... 454/353 X
6,135,875 A * 10/2000 French ..... 454/184
6,174,232 B1 * 1/2001 Stoll et al. ..... 454/184

* cited by examiner

*Primary Examiner*—Edward K. Look
*Assistant Examiner*—Richard A. Edgar

(57) ABSTRACT

A blower apparatus includes a blower housing having at least one airflow channel. A flexible sheet having at least one flap is coupled to the blower housing such that the flap overlaps the channel to form a one-way valve. A plurality of flaps may be positioned over a plurality of channels to form a blower apparatus with a plurality of one-way valves. The flexible sheet may include mounting features such as holes to facilitate assembly. For example, in one embodiment, the flexible sheet is pressed onto a plurality of pegs residing on the blower housing such that the holes receive the pegs. In another embodiment, the flexible sheet is pressed onto a plurality of pegs residing on an exhaust cover that is subsequently attached to the blower housing.

11 Claims, 5 Drawing Sheets

AIRFLOW FLAPPER VALVE

FIELD OF THE INVENTION

This invention relates to the field of blowers for equipment enclosures. In particular, this invention is directed to the elimination of reverse airflow through blowers.

BACKGROUND OF THE INVENTION

Cabinetry or enclosures for heat generating equipment may contain one or more blowers for active or forced air cooling. The blower displaces the air within the enclosure volume with cooler air external from the enclosure volume. The blower acts as a pump to transfer air between the two environments. Air pumped from the interior by the blower is replaced with air external to the enclosure through the vents or ports of the cabinet or enclosure. Alternatively, air pumped from the exterior of the enclosure into the enclosure displaces the air in the enclosure through the vents. Heat generating components requiring forced air cooling may overheat resulting in erratic, unpredictable behavior or a shortened lifespan among other maladies if there is no active cooling.

Blower systems may incorporate multiple blowers for redundancy or to achieve a specific airflow pattern in order to ensure adequate cooling. The failure of a single blower, however, creates a new source for air via its exhaust or intake vent. As a result, the airflow patterns within the enclosure may be sufficiently disrupted which prevents adequate cooling or which significantly decreases the efficiency of redundant blower systems.

Baffles may be used to prevent reverse airflow. Baffles have a number of members that pivot to enable opening and closing the baffle. Passive baffles typically rely on gravity or springs to keep the baffles closed when the blower is off. During normal operation, passive baffles rely upon the pressure developed by the blower to open. Active baffles require power and airflow detecting control circuitry at least to open the baffles. These passive or active baffle designs tend to introduce complexity into the manufacturing and assembly of the equipment enclosures. The active baffles undesirably require additional electrical connections and introduce additional points of failure due to the electrical components. The passive baffles additionally tend to significantly impede the flow of air through the blower exhaust thus imposing greater performance requirements on the blowers.

SUMMARY OF THE INVENTION

In view of limitations of known systems and methods, methods and apparatus for assembling a blower having a one-way valve are provided.

A method of assembling a blower includes the step of providing a blower housing having at least one channel. A flexible sheet having at least one flap is attached to the blower housing such that the flap overlaps the channel to form a one-way valve. The flexible sheet may include mounting features such as holes to facilitate assembly. For example, in one embodiment, the flexible sheet is pressed onto a plurality of pegs residing on the blower housing such that the holes receive the pegs. In another embodiment, the flexible sheet is pressed onto a plurality of pegs residing on an exhaust cover that is subsequently attached to the blower housing.

A blower apparatus includes a blower housing having a plurality of channels at an exhaust port. A flexible sheet having a plurality of flaps is coupled to the blower housing such that each flap overlaps at least one channel to form a one-way valve.

Other features and advantages of the present invention will be apparent from the accompanying drawings and from the detailed description that follows below.

BRIEF DESCRIPTION OF THE DRAWINGS

The present invention is illustrated by way of example and not limitation in the figures of the accompanying drawings, in which like references indicate similar elements and in which.

DETAILED DESCRIPTION

In a typical redundant air mover or blower system, the system must be designed to adequately accommodate both the loss of pumping ability and the reduction in efficiency due to changed airflow patterns. In a system having multiple air movers specifically to achieve a particular airflow pattern without regard to redundancy, the introduction of a new source (or sink) of air may disrupt the airflow patterns sufficiently to prevent adequate cooling.

Air movers are effectively air pumps formed by a motor having an impeller for a rotor. The impellers comprise a plurality of air moving surfaces such as blades. Air mover impellers may be classified as axial flow, centrifugal (i.e., radial) flow, or mixed flow with respect to how the air is moved relative to the axis of rotation of the impeller. The motor and blade designs are driven by the efficiency and power requirements of the application. The term "blower" will be used interchangeably with "air mover".

Figure 1:
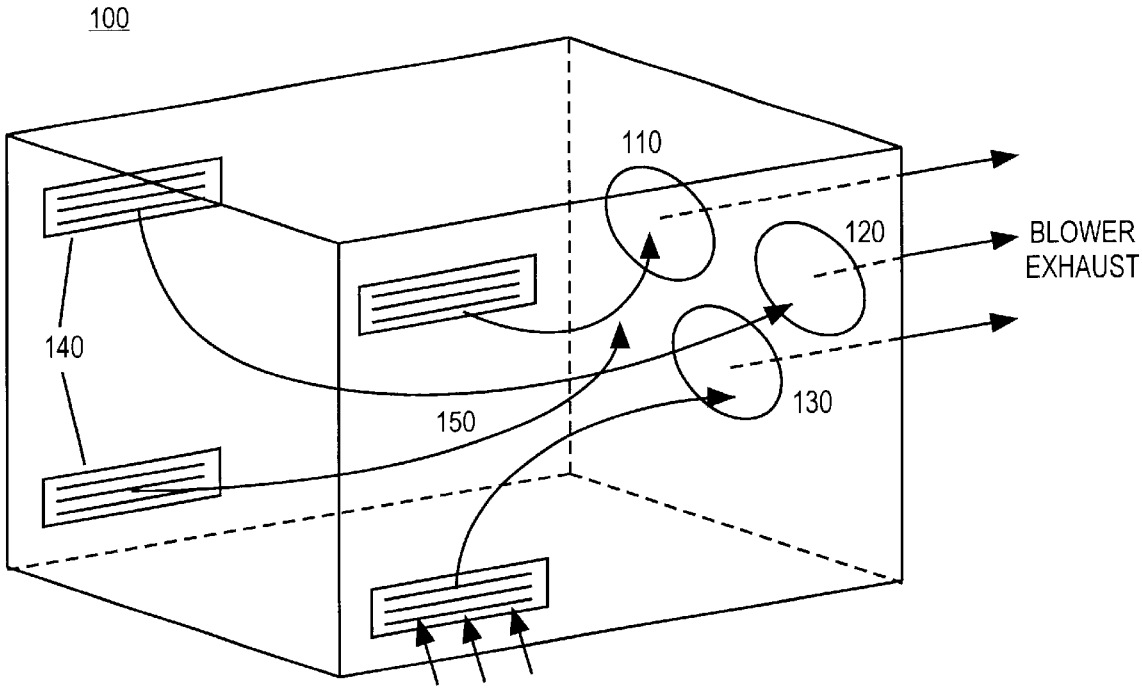
FIG. 1 illustrates one embodiment of airflow patterns in an enclosure utilizing a plurality of blowers for forced air cooling.

FIG. 1 illustrates one embodiment of an equipment enclosure 100 having a plurality of blowers 110, 120, 130 and vents 140. In this embodiment, airflow pattern indicators 150 show that forced air cooling is achieved when air external to the enclosure passes through vents 140 when replacing the air being pumped out of the enclosure by the blowers.

Figure 2:
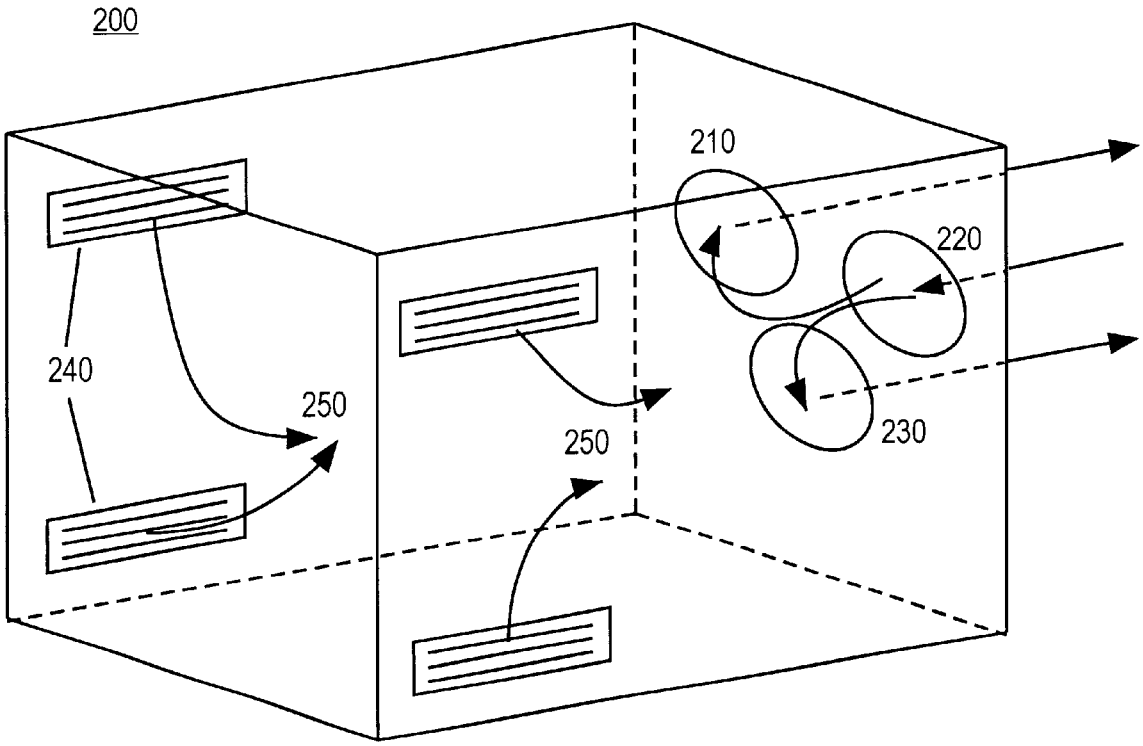
FIG. 2 illustrates disruption of airflow patterns due to reverse airflow through a failed blower.

The number and placement of the blowers may have been chosen for the purpose of redundancy or to achieve a specific airflow pattern without regard to the possibility of failure. FIG. 2 illustrates an enclosure 200 with operating blowers 210 and 230 and failed blower 220. The blowers reside at interfaces between the inside and the outside of the enclosure 200 and thus serve as unintended sources for external air compared to any other vents 240 in the event of failure. Reverse airflow through failed blower 220 undesirably disrupts the airflow 250 through the enclosure 200.

Figure 3:
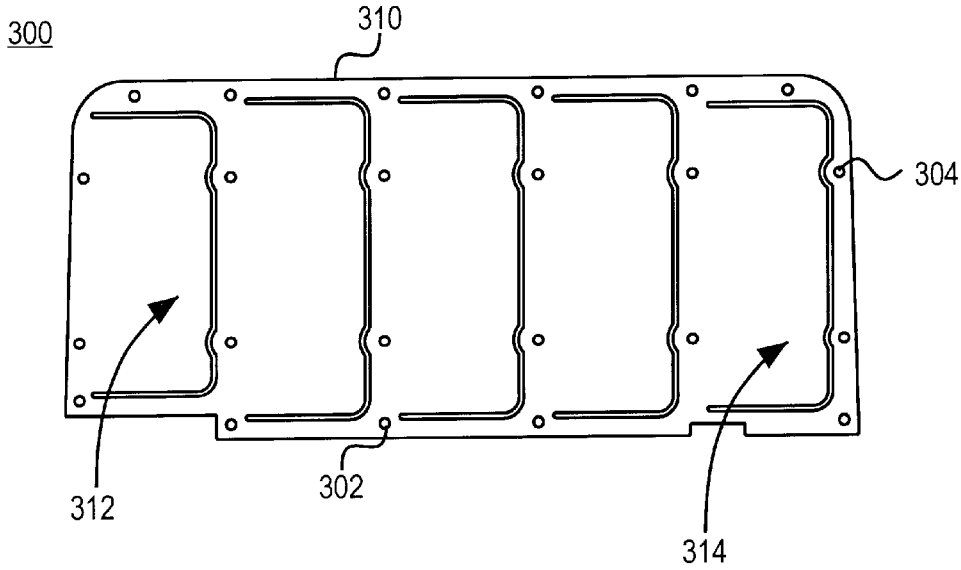
FIG. 3 illustrates one embodiment of a flapper valve.

FIG. 3 illustrates one embodiment of a passive baffle blower flapper valve 300. The flapper valve 310 is made of a thin, resilient, flexible material. The valve preferably includes a plurality of valves variously referred to as doors, flaps, flappers, valves, or louvers 312–314. Positive airflow from the blower causes the flaps or louvers 312–314 to flex open such that exhaust air may exit. When positive airflow ceases, the flaps return to the closed position. Due to the use of a thin, flexible material, this valve design does not significantly impede exhaust airflow. The valve of the illustrated embodiment introduces negligible resistance to airflow. Airflow resistance is a function of the number and design of the door cut outs, enclosure design, flapper valve thickness, and flapper valve material among other factors.

Any number of materials may be selected for the valve 300 including a variety of plastics, rubber, silicon rubber, elastomers, or even coated fabrics. A coated fabric such as COHRlastic® may be used to ensure meeting certain thermal ratings. The flapper material is sufficiently resilient to retain the louver substantially closed when its associated blower is not active.

The flapper valve may formed by die cutting the selected material. In one embodiment, the flapper valve incorporates a plurality of mounting holes 302, 304 or other mounting features to facilitate mounting on the blower housing.

Figure 4:
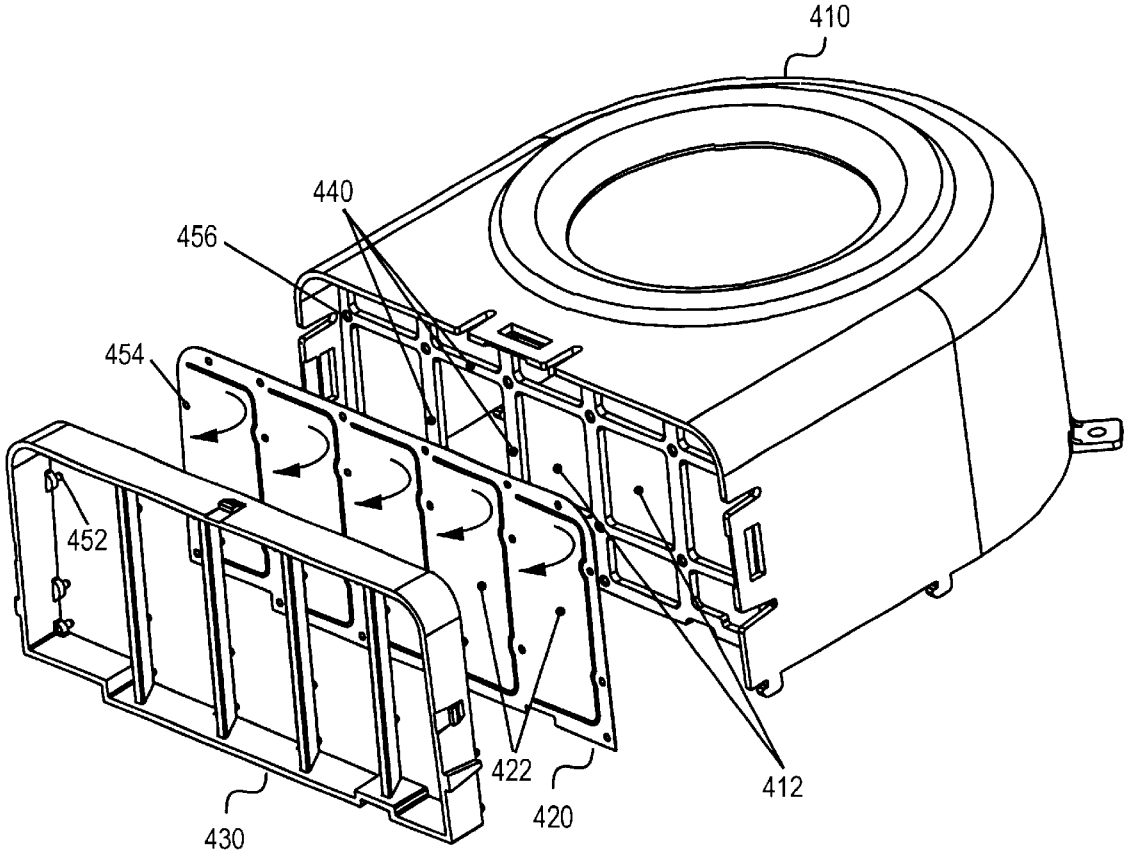
FIG. 4 illustrates one embodiment of the flapper valve and a blower housing.

FIG. 4 illustrates one embodiment of a blower housing 410, flapper valve 420, and exhaust cover 430. Blower housing 410 incorporates a motorized blower (not indicated). The motorized blower has an impeller with a plurality of blades. Common blade configurations include airfoil, backward inclined, backward curved, radial, paddle and forward curved configurations.

The housing 410 is designed with a plurality of channels 412 for the flaps 422. When the flapper valve 420 is attached to the blower housing, the flaps 422 overlap the channel 412 boundaries 440 to prevent the flaps from opening inwards, thus eliminating reverse airflow through the blower.

In one embodiment, the flapper valve includes a plurality of mounting features 454 to facilitate attachment to the exhaust cover and/or the blower. The cover and the blower housing may also have features that cooperate with the mounting features of the flapper valve.

In the illustrated embodiment, the cover 430 includes a plurality of pegs 452 which pass through corresponding holes 454, 456 in the flapper valve and in the blower housing, respectively. The cover is designed to permit the flaps 422 to flex outwards when the blower is active. The channel boundaries, however, prevent the flaps from opening inwards.

In an alternative embodiment, pegs may be located on the blower housing. The flapper valve is pressed onto the blower housing so that the plurality of mounting holes receive the pegs. An exhaust cover may be provided to ensure that the valve is retained on the pegs.

Figure 5:
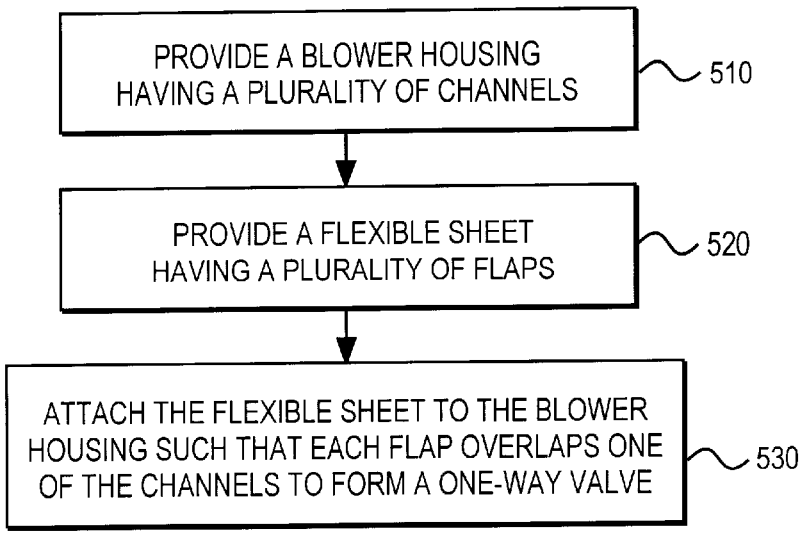
FIG. 5 illustrates one embodiment of a method of assembling a blower having a one way valve.

FIG. 5 illustrates one embodiment of a method of assembling the blower apparatus incorporating the one-way valve. In step 510, a blower housing having a plurality of channels is provided. A flexible sheet having a plurality of flaps is provided in step 520. In step 530, the flexible sheet is attached to the blower housing such that each flap overlaps at least one channel to form a one-way valve.

Figure 6:
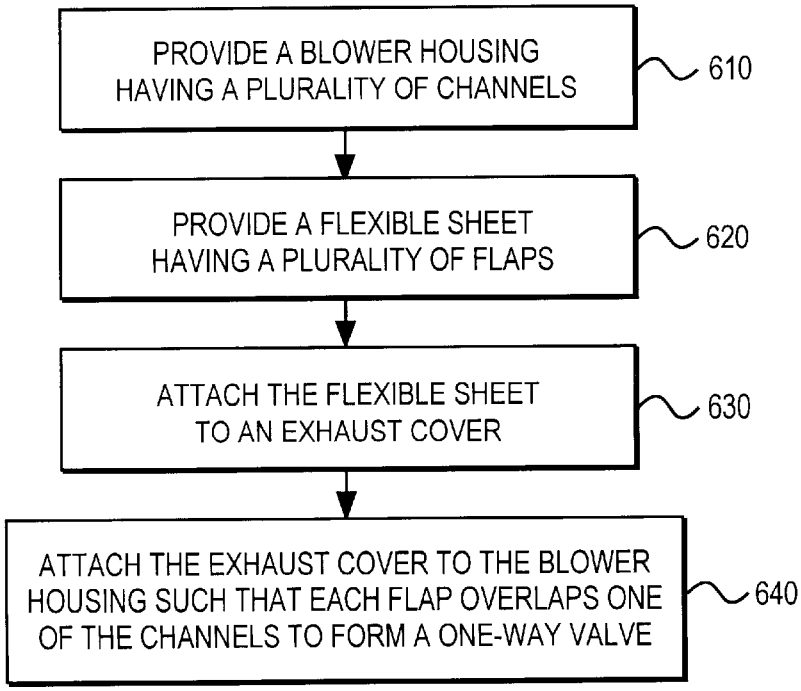
FIG. 6 illustrates an alternative embodiment of a method of assembling a blower having a one way valve.

FIG. 6 illustrates an alternative embodiment of a method of assembling a blower apparatus incorporating a one-way valve. In step 610, a blower housing having a plurality of channels is provided. A flexible sheet having a plurality of flaps is provided in step 620. The flexible sheet is attached to an exhaust cover in step 630. The cover is then placed on the blower housing such that each flap overlaps a channel to form a one-way valve.

In the preceding detailed description, the invention is described with reference to specific exemplary embodiments thereof. Various modifications and changes may be made thereto without departing from the broader spirit and scope of the invention as set forth in the claims. The specification and drawings are, accordingly, to be regarded in an illustrative rather than a restrictive sense.

What is claimed is:

1. An apparatus comprising:

an equipment enclosure having a plurality of air exchange interfaces for exchanging air between the interior and exterior of the enclosure;

a plurality of blowers, each blower residing at one of the air exchange interfaces, each blower further comprising:

a blower housing having a plurality of airflow channels;

a flexible sheet having a plurality of flaps; and an exhaust cover, wherein the flexible sheet is disposed between the blower housing and the exhaust cover, wherein each flap is disposed over at least one channel to form a one-way valve, wherein each of the exhaust cover and the blower housing provides a support member between adjacent flaps.

2. The apparatus of claim 1 wherein the blower housing comprises a plurality of pegs, wherein the flexible sheet has a plurality of holes for receiving the pegs.

3. The apparatus of claim 1 wherein the flexible sheet is attached to the exhaust cover, wherein the exhaust cover is attached to the blower housing.

4. The apparatus of claim 3 wherein the exhaust cover further comprises a plurality of pegs, wherein the flexible sheet has a plurality of holes for receiving the pegs.

5. A blower apparatus comprising:

a blower housing having a plurality of airflow channels;

a flexible sheet having a plurality of flaps; and an exhaust cover, wherein the flexible sheet is disposed between the blower housing and the exhaust cover, wherein each flap is disposed over at least one channel to form a one-way valve, wherein each of the exhaust cover and the blower housing provides a support member between adjacent flaps.

6. The apparatus of claim 5 wherein the flexible sheet is attached to the exhaust cover, wherein the exhaust cover is attached to the blower housing.

7. The apparatus of claim 6 wherein the exhaust cover further comprises a plurality of pegs, wherein the flexible sheet has a plurality of holes for receiving the pegs.

8. The apparatus of claim 5 wherein the blower housing comprises a plurality of pegs, wherein the flexible sheet has a plurality of holes for receiving the pegs.

9. A method of assembling a blower, comprising the steps of:

a) providing a blower housing having a plurality of channels;

b) providing a flexible sheet having a plurality of flaps; and c) providing an exhaust cover attached to the blower housing, wherein the flexible sheet is disposed between the blower housing and the exhaust cover, wherein each flap is disposed over at least one channel to form a one-way valve, wherein each of the exhaust cover and the blower housing provides a support member between adjacent flaps.

10. The method of claim 1 wherein step c) further comprises the step of:

i) pressing the flexible sheet onto a plurality of pegs residing on the blower housing.

11. The method of claim 9 wherein step c) further comprises the steps of:

i) pressing the flexible sheet onto a plurality of pegs residing on the exhaust cover; and ii) attaching the exhaust cover to the blower housing.

* * * * *